US009437914B2

(12) United States Patent
Chueh

(10) Patent No.: US 9,437,914 B2
(45) Date of Patent: Sep. 6, 2016

(54) POWER PROCESSING CIRCUIT AND MULTIPLEX AMPLIFICATION CIRCUIT

(71) Applicant: HON HAI PRECISION INDUSTRY CO., LTD., New Taipei (TW)

(72) Inventor: Yu-Chih Chueh, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 49 days.

(21) Appl. No.: 14/485,418

(22) Filed: Sep. 12, 2014

(65) Prior Publication Data

US 2015/0280305 A1 Oct. 1, 2015

(30) Foreign Application Priority Data

Mar. 27, 2014 (CN) ..... 2014 1 0119939

(51) Int. Cl.
*H01P 5/16* (2006.01)
*H01P 5/12* (2006.01)
*H01P 1/203* (2006.01)

(52) U.S. Cl.
CPC ..... *H01P 5/12* (2013.01); *H01P 1/203* (2013.01); *H01P 5/16* (2013.01)

(58) Field of Classification Search
CPC ..... H01P 5/12; H01P 5/16
USPC ..... 333/124, 125, 127, 128, 136
See application file for complete search history.

(56) References Cited

U.S. PATENT DOCUMENTS 5,162,756 A * 11/1992 Taniguchi ..... H03F 3/604 330/295
5,430,418 A * 7/1995 Blodgett ..... H03H 7/48 333/100
5,847,625 A * 12/1998 Gillette ..... H01P 5/16 333/127
6,054,906 A * 4/2000 Kim ..... H04B 1/0458 333/124
9,178,263 B1 * 11/2015 Podell ..... H01P 5/16

FOREIGN PATENT DOCUMENTS

CN 201528031 7/2010

* cited by examiner

*Primary Examiner* — Dean Takaoka
*Assistant Examiner* — Alan Wong
(74) *Attorney, Agent, or Firm* — Zhigang Ma

(57) ABSTRACT

A power processing circuit includes a first portion, a second portion, a third portion, a resistor, a first coupling portion, and a second coupling portion. The first portion, the second portion, and the third portion are connected to respective external components. The resistor is used for isolating signals between the second portion and the third portion. The first coupling portion and the second coupling portion are substantially U-shaped coupling structures and are positioned at different sides of the resistor. The first coupling portion is connected to the first portion, the second portion, and ground. The second coupling portion is connected to the first portion, the third portion, and ground.

20 Claims, 13 Drawing Sheets

POWER PROCESSING CIRCUIT AND MULTIPLEX AMPLIFICATION CIRCUIT

FIELD

The disclosure relates to electronic circuits, and particularly to a power processing circuit and a multiplex amplification circuit.

BACKGROUND

In mobile communications, it is necessary to divide an input power proportionally for several output circuits. A power divider is often used to divide a single input power into two or more equal or unequal output powers. Meanwhile, the power divider is also used as a power combiner to combine several input powers into a single output power.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one."

One embodiment of a power processing circuit is a circuit printed on a PCB to divide or combine powers of signals. One embodiment of a multiplex amplification circuit is a circuit printed on a PCB to enhance transmission power of signals.

It should be noted that different shadings of the following drawings are used to distinguish different parts of the structures of the embodiments in order to describe more clearly.

Figure 1:
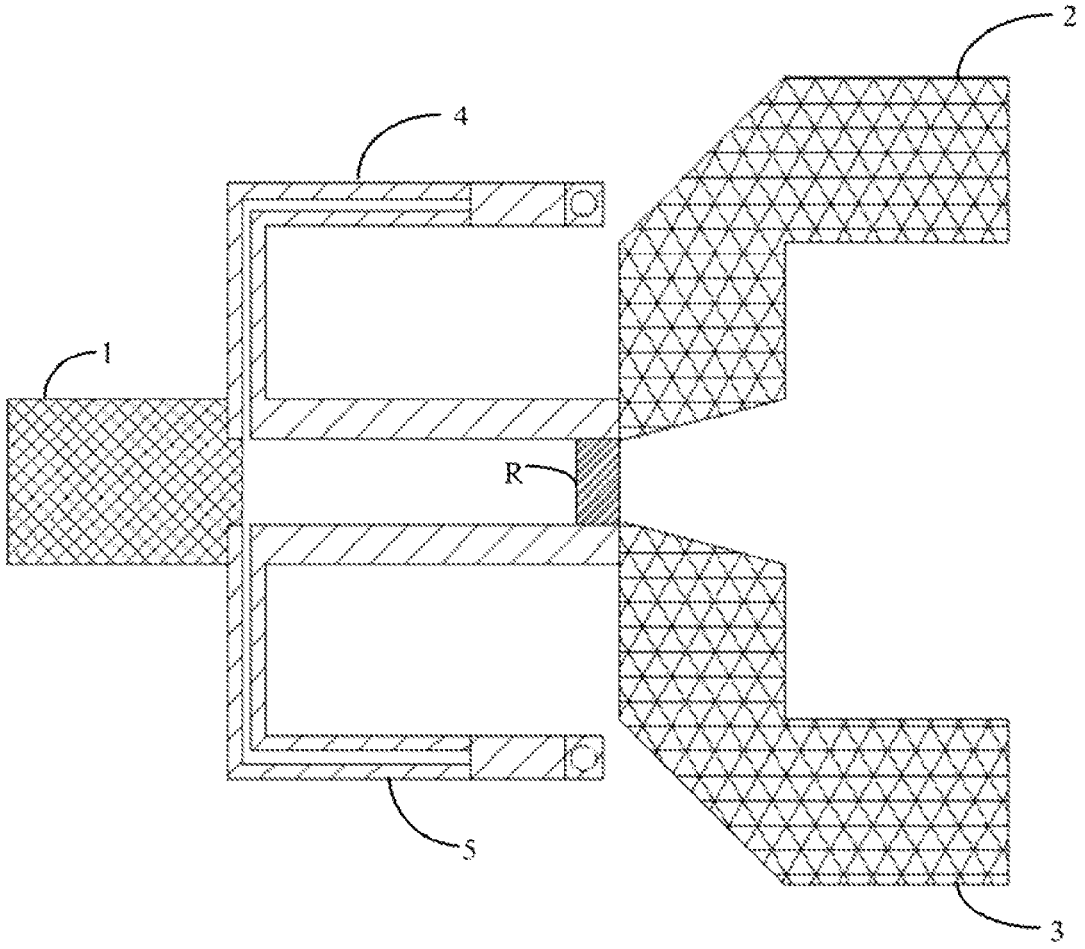
FIG. 1 is a schematic diagram of one embodiment of a power processing circuit.

FIG. 1 illustrates a schematic diagram of one embodiment of a power processing circuit. As can be seen from FIG. 1, the power processing circuit includes a first portion 1, a second portion 2, a third portion 3, two coupling structures (i.e., a first coupling portion 4 and a second coupling portion 5), and a resistor R.

When the power processing circuit is dividing power of signals, the first portion 1 is connected to an output port of external components to receive signals from the external components, and the second portion 2 and the third portion 3 are connected to respective input ports of external components to transmit signals to the external components.

When the power processing circuit is combining powers of signals, the first portion 1 is connected to an input port of external components to transmit signals to the external components, and the second portion 2 and the third portion 3 are connected to separate output ports of external components to receive signals from the external components.

The resistor R is located between the second portion 2 and the third portion 3 to isolate signals between the second portion 2 and the third portion 3. Thus, interference among different signals is reduced. In the present embodiment, the resistor R has a resistance of about 100 ohms and a package size of 0402. In other embodiments, a different kinds of resistor can be used according to actual needs.

The first coupling portion 4 is connected to a first end portion of the resistor R, while the second coupling portion 5 is connected to a second end portion of the resistor R. The first coupling portion 4 and the second coupling portion 5 are symmetrically located about the resistor R to divide a single input power of signals into two output powers of signals, or combine two input powers of signals into one output power of signals. In the embodiment, the first coupling portion 4 and the second coupling portion 5 are substantially the same.

Figure 2:
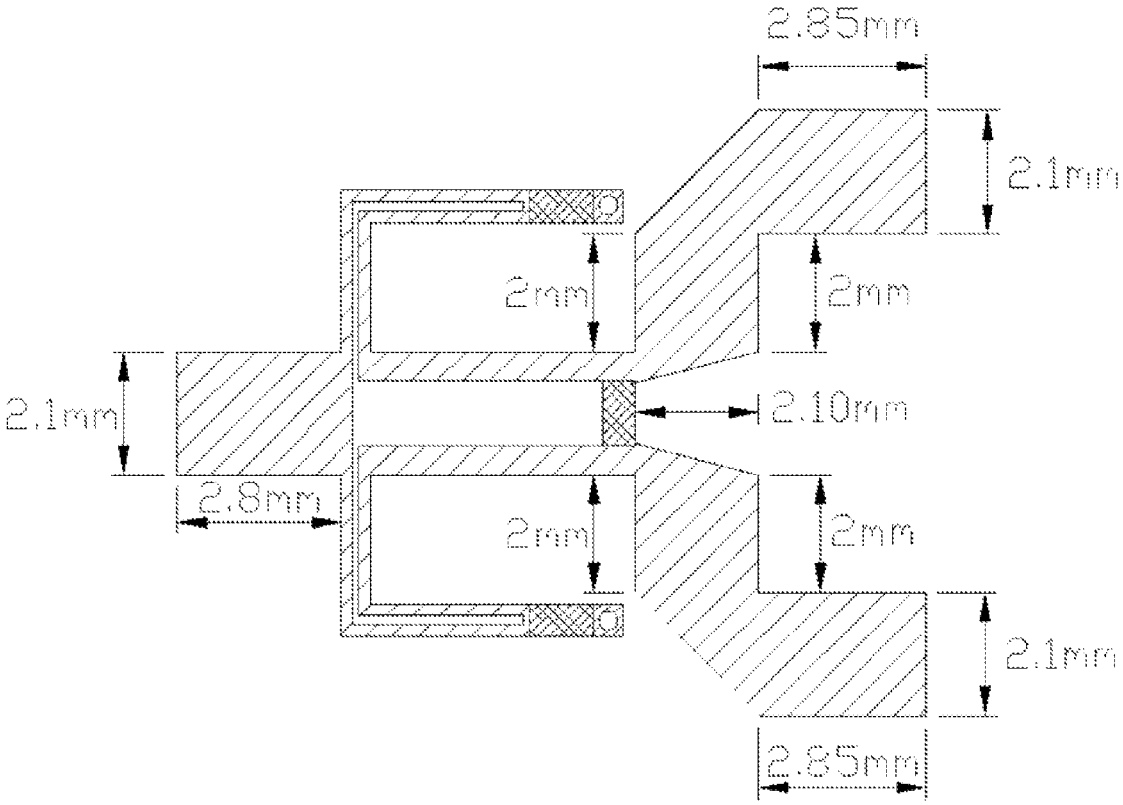
FIG. 2 is a size diagram of the power processing circuit.

FIG. 2 illustrates a size diagram of the embodiment of a power processing circuit.

Figure 3:
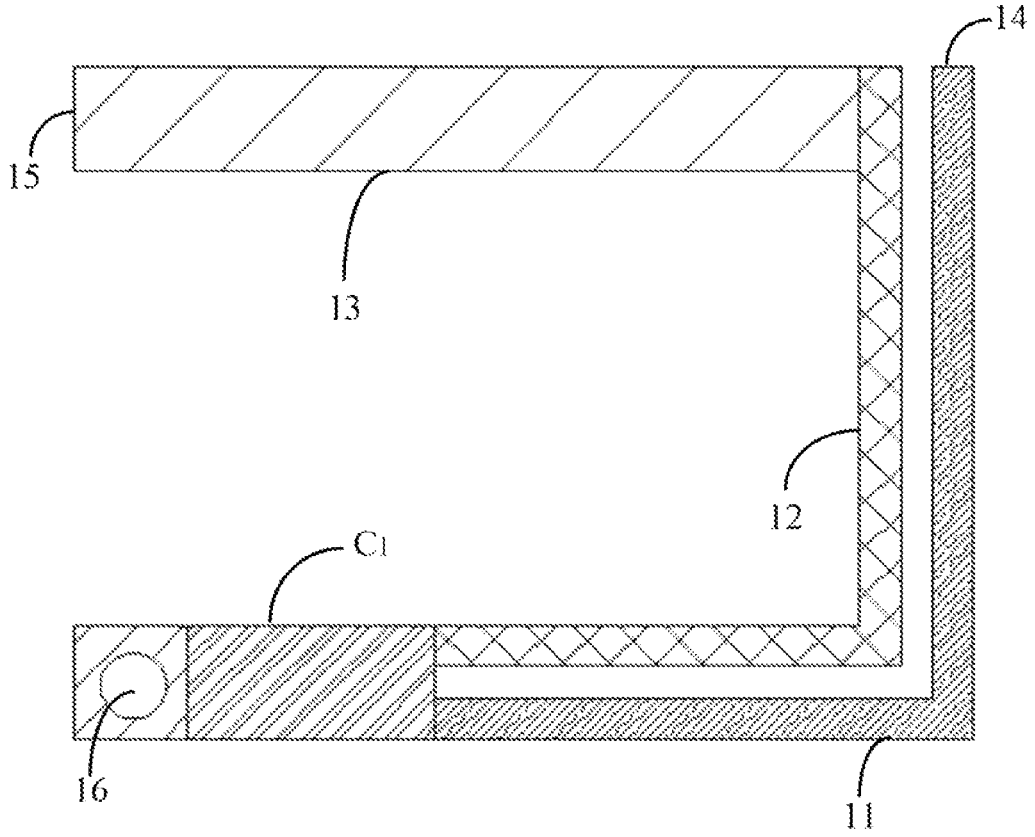
FIG. 3 is a diagram of one embodiment of a coupling structure of the power processing circuit of FIG. 1.

FIG. 3 illustrates a diagram of the coupling structures. Each coupling structure is substantially U-shaped. The coupling structure includes a first coupling line 11, a second coupling line 12, a first capacitor $C_1$, and a short microstrip line 13. An L-shaped gap (not labeled) is defined between the first coupling line 11 and the second coupling line 12, and the first coupling line 11 and the second coupling line 12 form coupling transmission lines. A first end portion of the first coupling line 11, a first end portion of the second coupling line 12, and a first end portion of the first capacitor $C_1$ are connected together. In at least one embodiment, the first capacitor $C_1$ has a capacitance of about 0.4 picofarads (pF) and a package size of 0402. In other embodiments, a different kind of capacitor can be used according to actual needs. A second end portion of the first coupling line 11 is used as a signal terminal 14, a second end portion of the second coupling line 12 is connected to a first end portion of the short microstrip line 13, and a second end portion of the first capacitor $C_1$ is connected to ground through a via 16. A second end portion of the short microstrip line 13 is used as a signal terminal 15. The first coupling line 11 and the second coupling line 12 are both substantially L-shaped microstrip lines bent at a right angle and are substantially parallel to each other.

Referring to FIG. 1, the signal terminal 14 of the first coupling portion 4 is connected to the first portion 1, and the signal terminal 15 of the first coupling portion 4 is connected to the second portion 2. The signal terminal 14 of the second coupling portion 5 is connected to the first portion 1, and the signal terminal 15 of the second coupling portion 5 is connected to the third portion 3.

Figure 4:
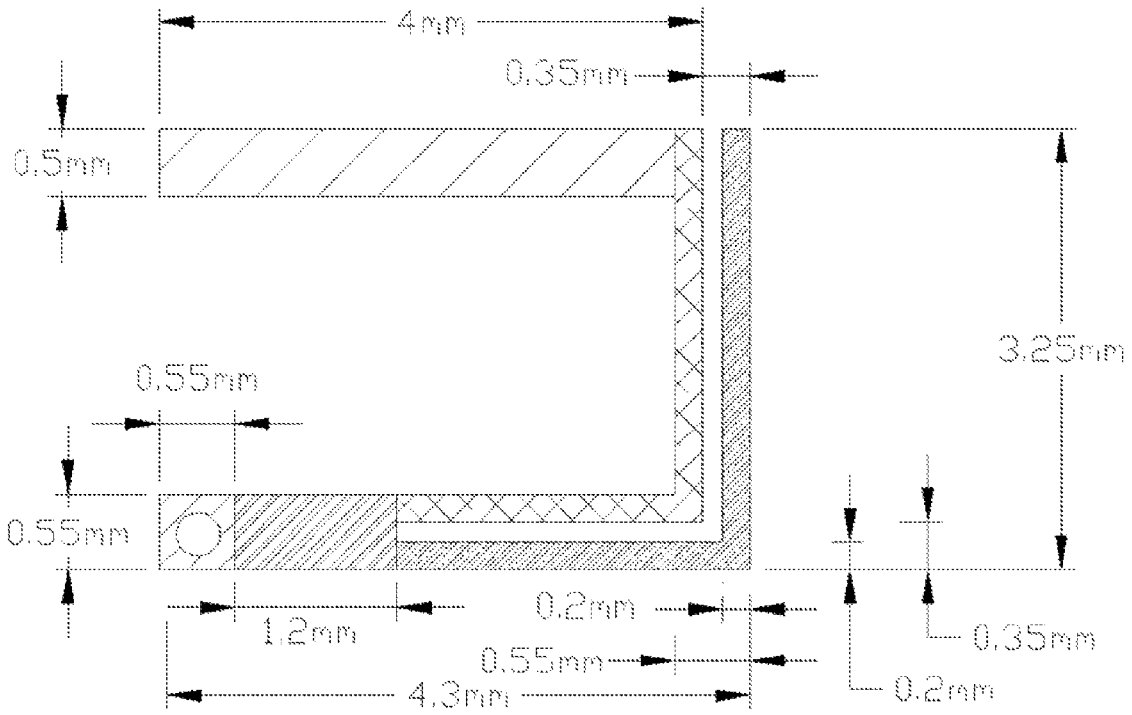
FIG. 4 is a size diagram of the coupling structure of FIG. 3.

FIG. 4 illustrates a size diagram of the first coupling portion 4 and the second coupling portion 5 of FIG. 1.

Figure 5:
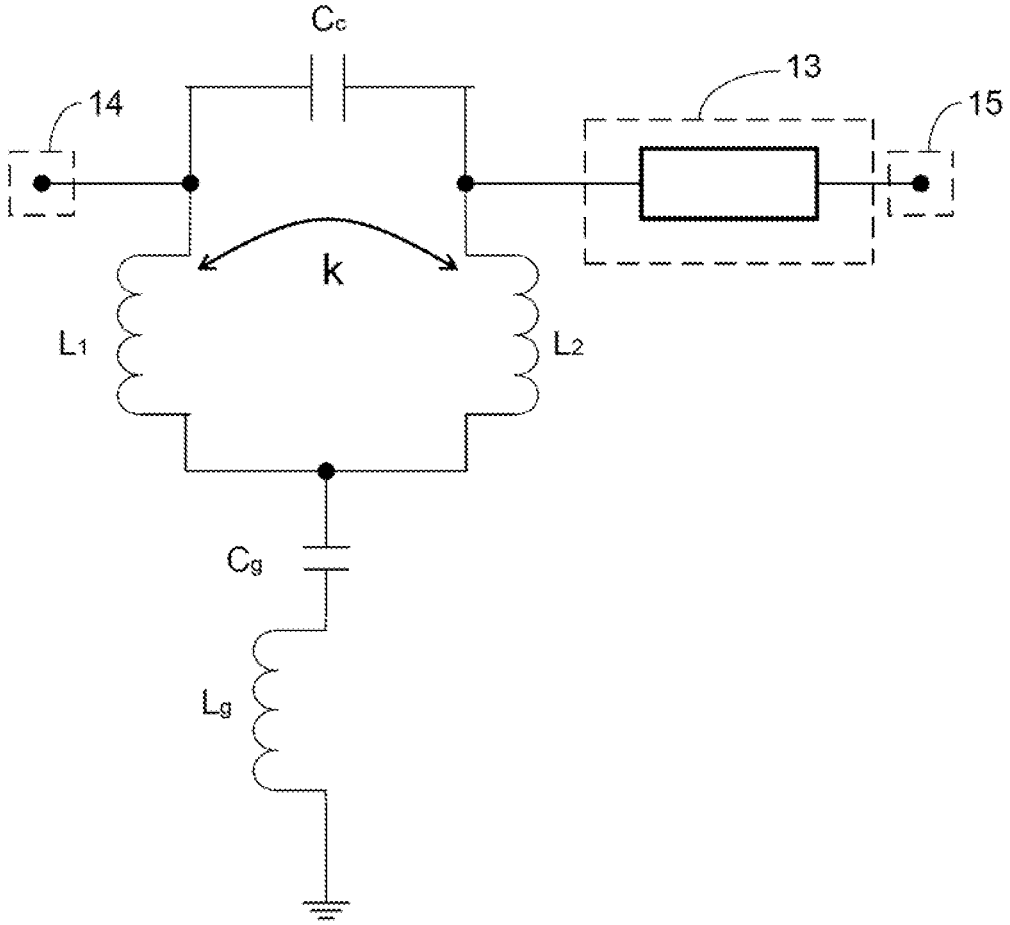
FIG. 5 is an equivalent circuit of the coupling structure of FIG. 3.

FIG. 5 illustrates an equivalent circuit of the first coupling portion 4 and the second coupling portion 5 of FIG. 1. The first coupling line 11 and the second coupling line 12 are equivalent to inductors $L_1$ and $L_2$, respectively. Electromagnetic waves of the inductors $L_1$ and $L_2$ are coupled together with a coupling coefficient K to form a mutual induction effect. A coupling capacitor between the first coupling line 11 and the second coupling line 12 is equivalent to a capacitor $C_c$. The first capacitor $C_1$ and the via 16 are equivalent to a capacitor $C_g$ and an inductor $L_g$, wherein the capacitor $C_g$ and the inductor $L_g$ are connected in series to form a series circuit. A first end of the inductor $L_1$ is connected to a first end of the inductor $L_2$, and further connected to ground through the series circuit of the capacitor $C_g$ and the inductor $L_g$. A second end of the inductor $L_1$ is connected to a first end of the capacitor $C_c$, while a second end of the inductor $L_2$ is connected to a second end of the capacitor $C_c$. A connection point of the inductor $L_1$ and the capacitor $C_c$ is used as the signal terminal 14, and a connection point of the inductor $L_2$ and the capacitor $C_c$ is used as the signal terminal 15.

In at least one embodiment, an impedance of the coupling structure is about 70.7 ohms, and an electrical length of the coupling structure is about 90 degrees when a frequency of the coupling structure is about 2.45 gigahertz (GHz).

Parameters S (scattering parameters) are applied to evaluate performance of transmission signals and reflected signals. Considering the coupling structure and the equivalent circuit of the coupling structure, the coupling structure can be equivalent to a two-port network, wherein the signal terminal 14 is a first end of the two-port network, and the signal terminal 15 is a second end of the two-port network.

Figure 6:
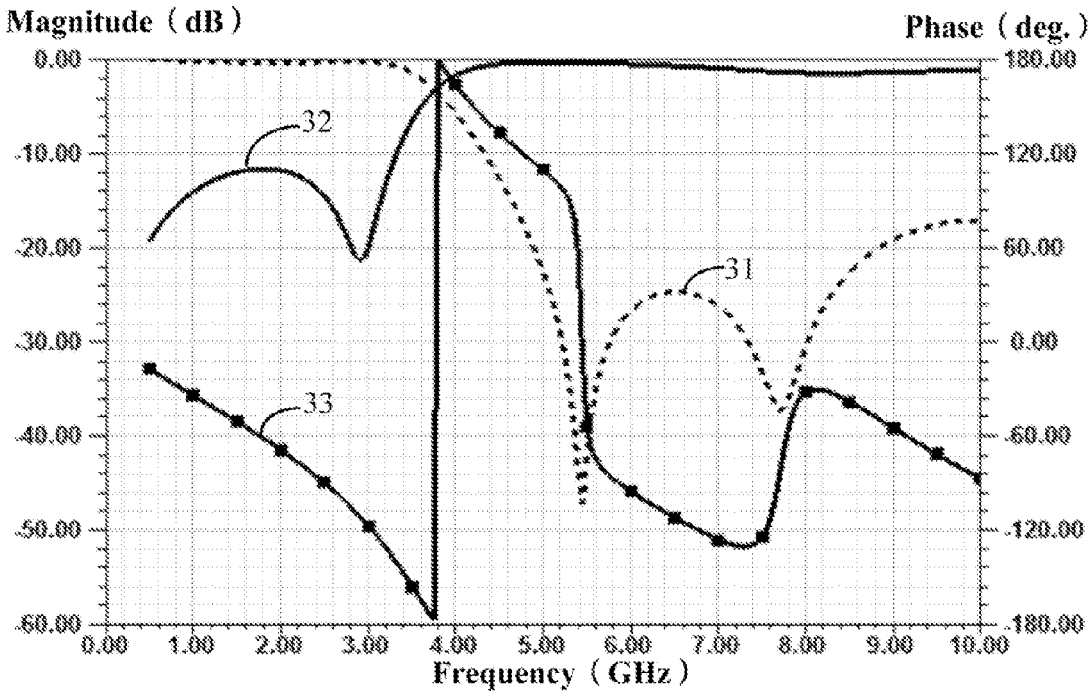
FIG. 6 is a diagram showing characteristics of $S_{11}$, $S_{21}$ and phases of a coupling structure of the power processing circuit of FIG. 1.
Figure 7:
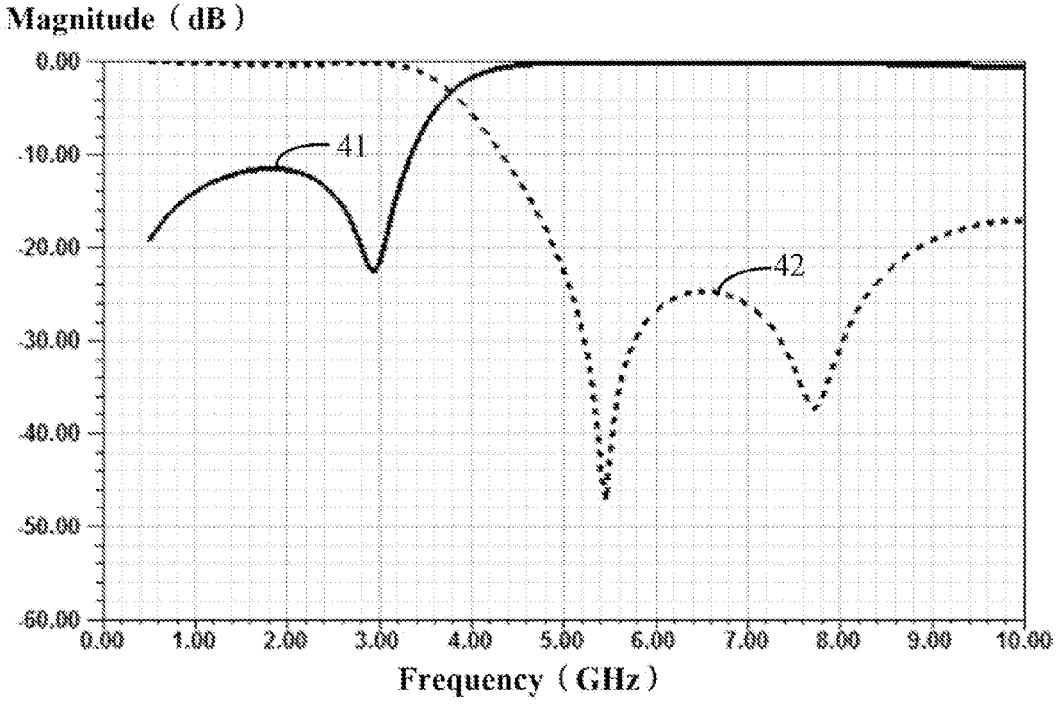
FIG. 7 is a diagram showing characteristics of $S_{12}$ and $S_{22}$ of a coupling structure of the power processing circuit of FIG. 1.

In FIG. 6, curve 31 shows a transmission coefficient $S_{21}$ from the first end to the second end of the two-port network, curve 32 shows a reflection coefficient $S_{11}$ of the first end of the two-port network, and curve 33 shows phase relations from the first end to the second end of the two-port network. In FIG. 7, curve 41 shows a reflection coefficient $S_{22}$ of the second end of the two-port network, and curve 42 shows a transmission coefficient $S_{12}$ from the second end to the first end of the two-port network. The transmission coefficient $S_{21}$ is equal to the transmission coefficient $S_{12}$, and curve 31 is equal to curve 42. Curve 32 and curve 41 describes characteristics of return loss. When the coupling structure works at a frequency of about 2.45 gigahertz (GHz), the return loss is less than negative 10 decibels (dB). When an ordinate of a point of curve 33 is equal to negative 90 degrees, an abscissa of the point of curve 33 is 2.45 gigahertz (GHz). Thus, the electrical length of the coupling structure is about 90 degrees when the frequency of the coupling structure is about 2.45 gigahertz (GHz). Moreover, there are two transmission zero points to better suppress harmonic distortion when the frequency is about 5.45 gigahertz (GHz) and about 7.8 gigahertz (GHz).

Figure 8:
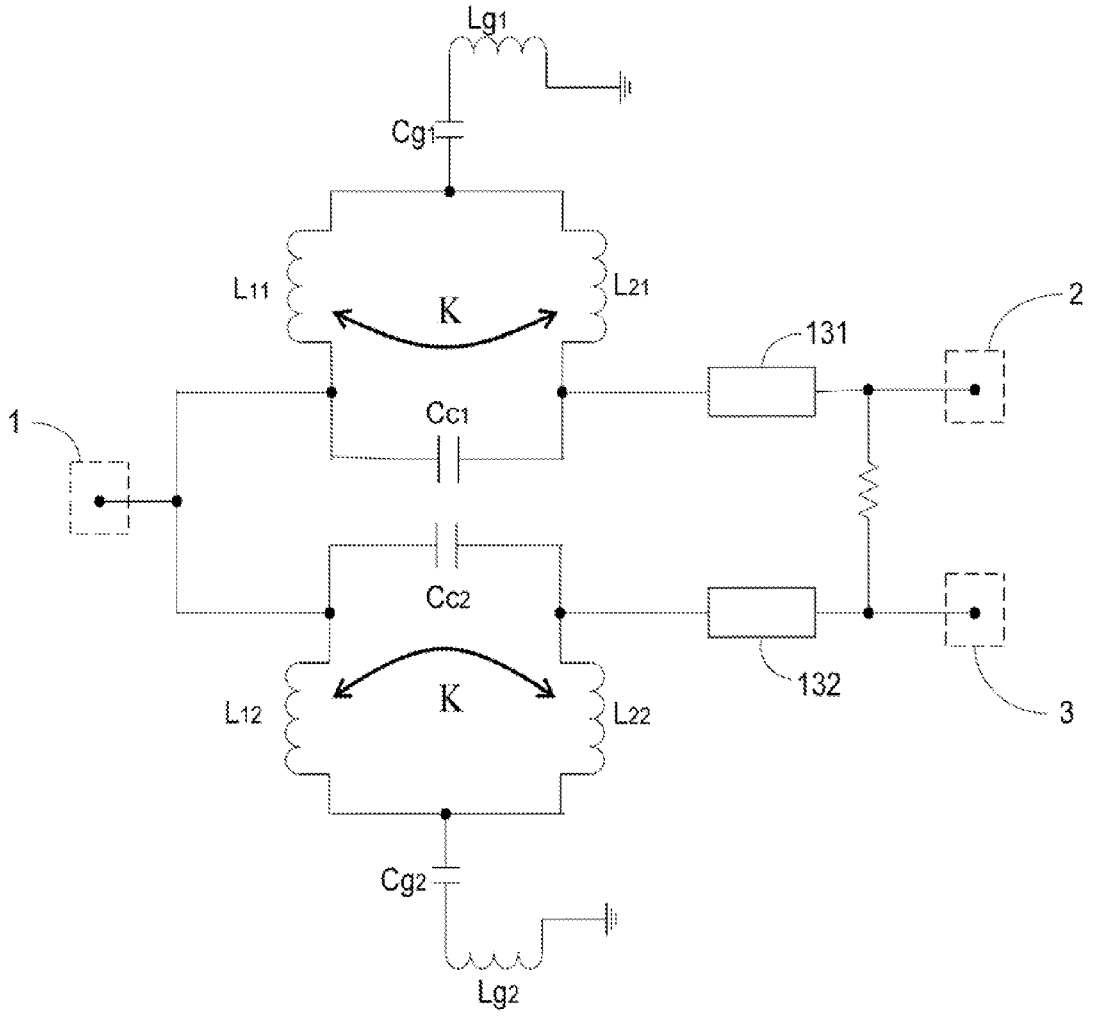
FIG. 8 is an equivalent circuit of the power processing circuit.
Figure 9:
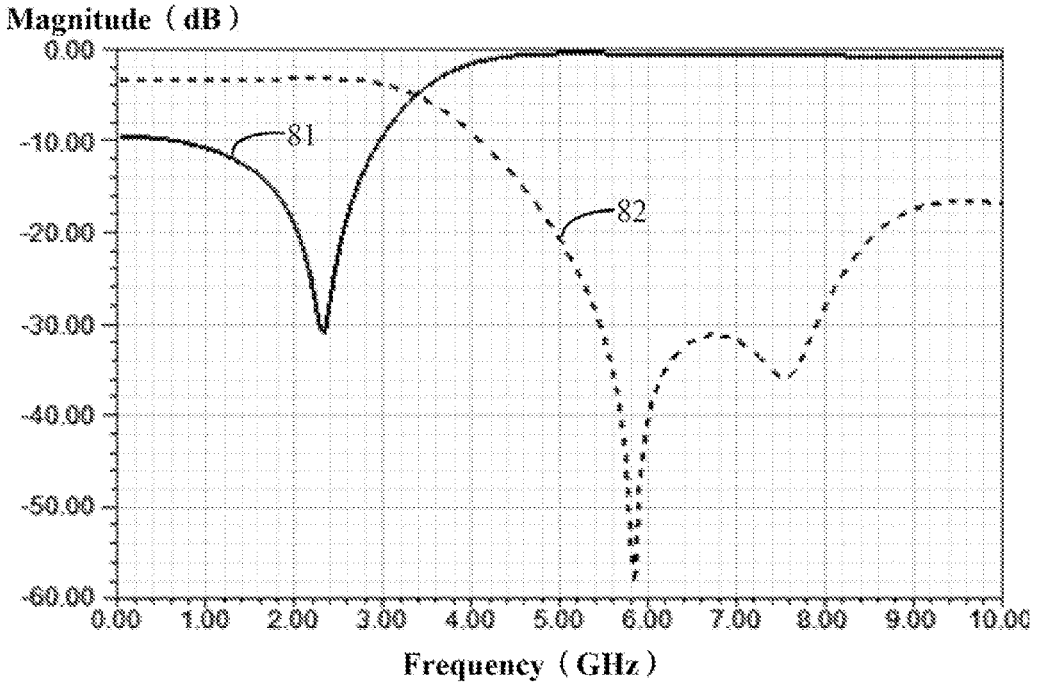
FIG. 9 is a diagram showing characteristics of $S_{11}$ and $S_{21}$ of the power processing circuit of FIG. 8.
Figure 10:
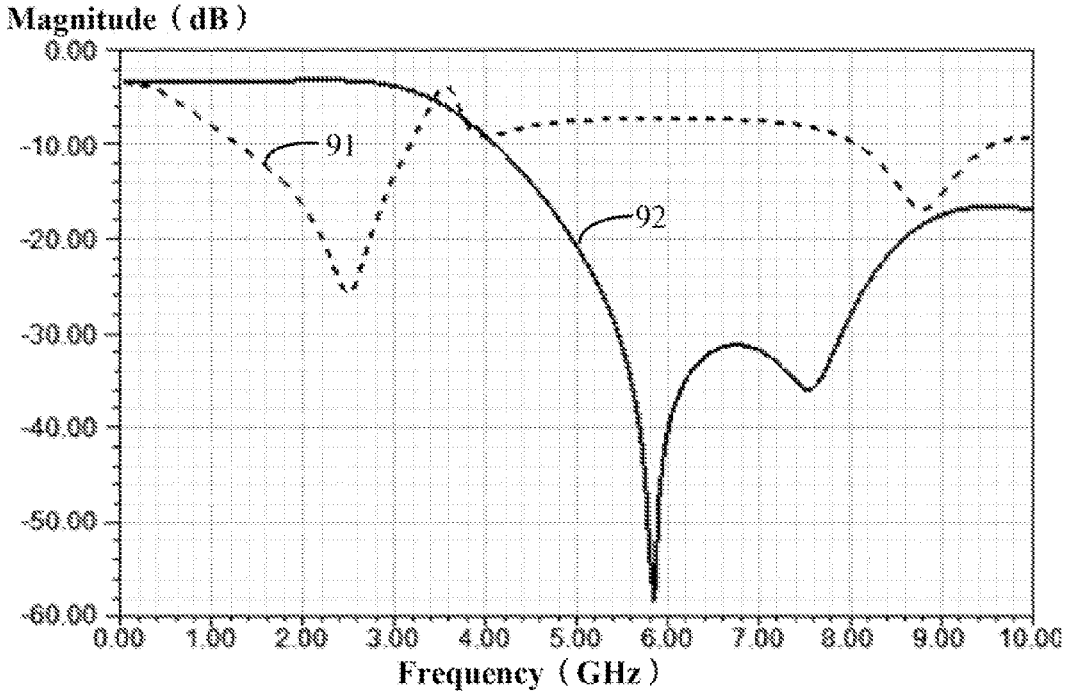
FIG. 10 is a diagram showing characteristics of $S_{31}$ and $S_{32}$ of the power processing circuit of FIG. 8.

FIG. 8 illustrates a second embodiment of an equivalent circuit of a power processing circuit. FIG. 9 illustrates a diagram showing characteristics of the power processing circuit of FIG. 8. FIG. 10 illustrates a diagram showing characteristics of $S_{31}$ and $S_{32}$ of the power processing circuit of FIG. 8.

In FIG. 9, curve 81 shows a reflection coefficient $S_{11}$ of the first portion 1, and curve 82 shows a transmission coefficient $S_{21}$ from the first portion 1 to the second portion 2. In FIG. 10, curve 91 shows isolations $S_{32}$ of the second portion 2 and the third portion 3, and curve 92 shows a transmission coefficient $S_{31}$ from the first portion 1 to the third portion 3. As can be seen from curve 81, when the power processing circuit works at a frequency of about 2.45 gigahertz (GHz), the return loss is less than negative 10 dB. The power processing circuit has characteristics of a wide stopband and a low-pass filter, so that there is no need to add extra filters.

Figure 11:
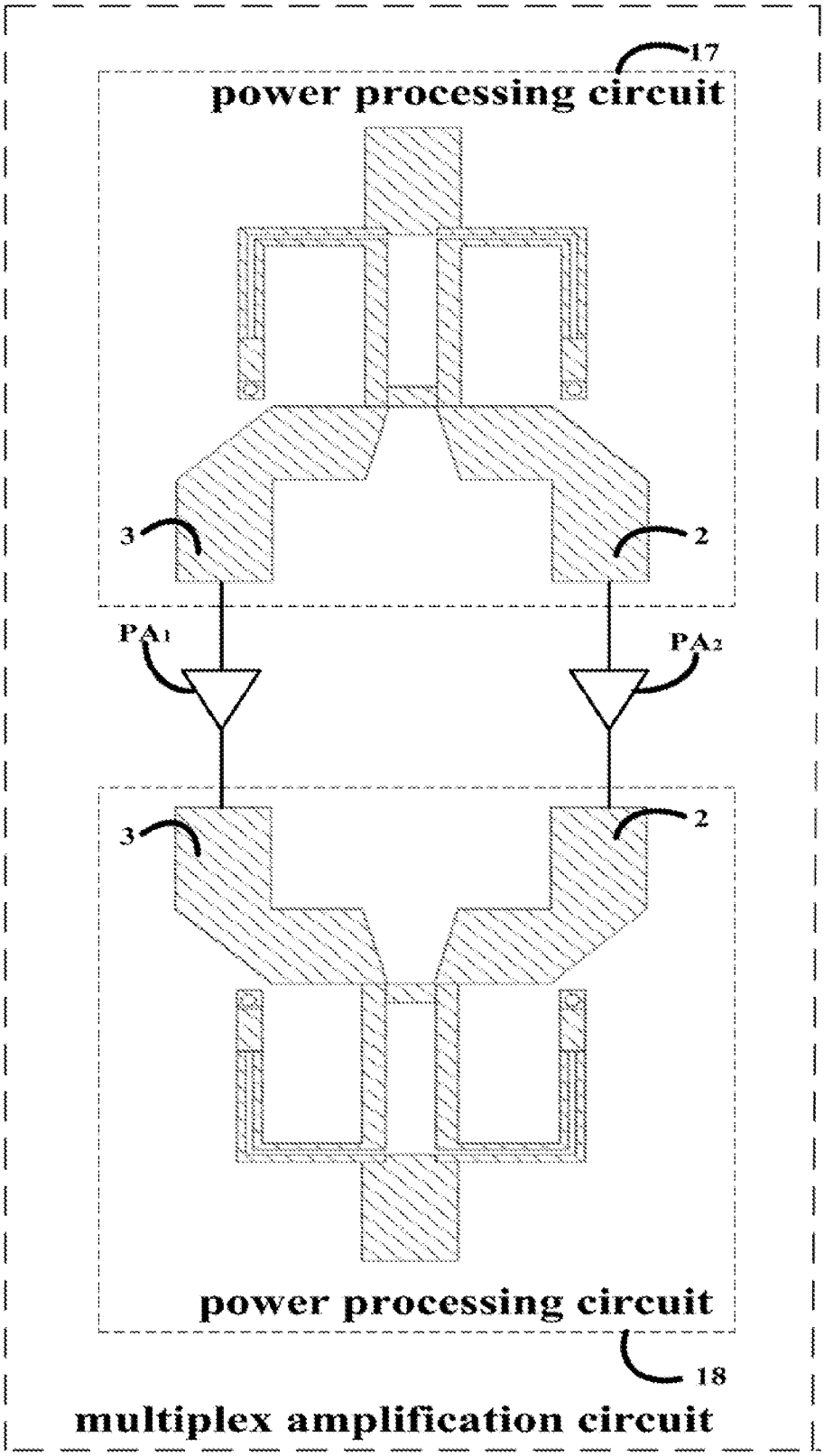
FIG. 11 is a schematic diagram of one embodiment of a two-way amplification circuit.

FIG. 11 illustrates a schematic diagram of one embodiment of a two-way amplification circuit. The two-way amplification circuit is a connection path of the multiplex amplification circuit. The two-way amplification circuit includes a power processing circuit 17, a power processing circuit 18, and two amplifiers $PA_1$ and $PA_2$, wherein the power processing circuit 17 and the power processing circuit 18 are the power processing circuits shown in FIG. 1. The power processing circuit 17 divides a single input power of signals into two output powers of signals, while the power processing circuit 18 combines two input powers of signals into a single output power of signals. A second portion 2 and a third portion 3 of the power processing circuit 17 are connected to input ports of the amplifiers $PA_1$ and $PA_2$, respectively, while a second portion 2 and a third portion 3 of the power processing circuit 18 are connected to output ports of the amplifiers $PA_1$ and $PA_2$, respectively.

Figure 12:
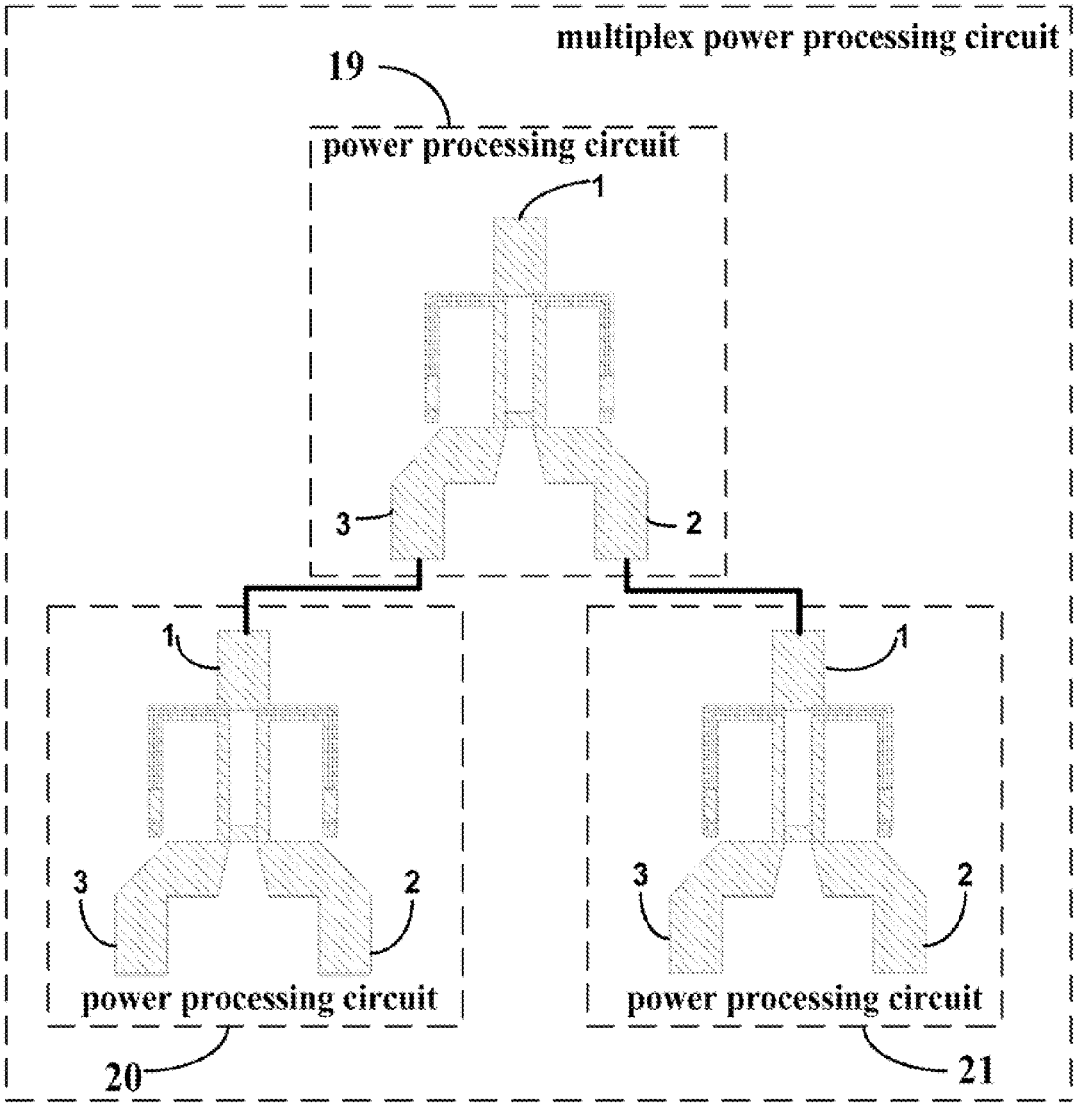
FIG. 12 is a schematic diagram of an embodiment of a multiplex power processing circuit.

FIG. 12 illustrates a schematic diagram of another embodiment of a multiplex power processing circuit. In FIG. 12, a second portion 2 and a third portion 3 of a power processing circuit 19 are connected to a first portion 1 of a power processing circuit 21 and a first portion 1 of a power processing circuit 20, respectively to form a cascade connection and a four-way power processing circuit.

Figure 13:
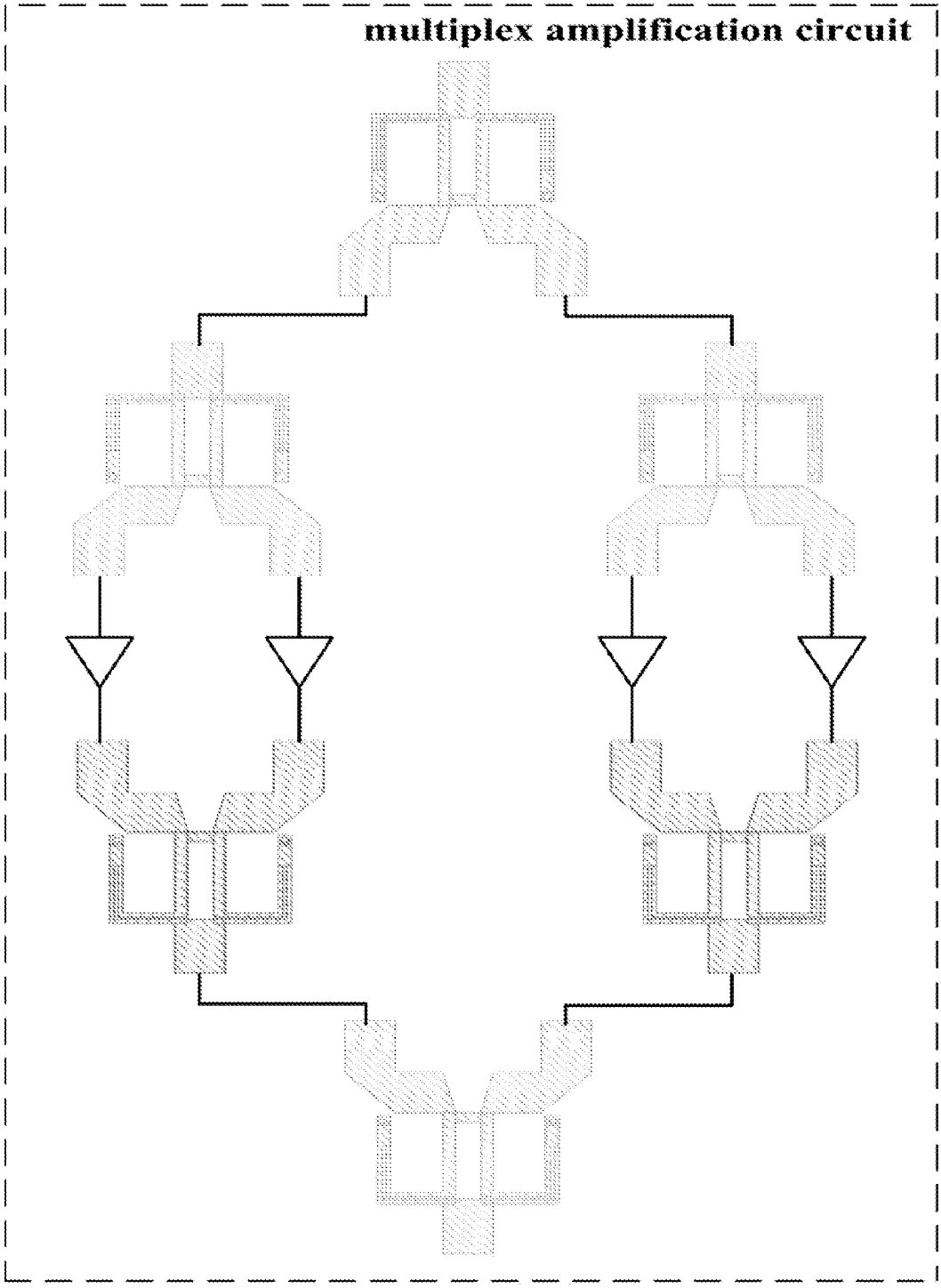
FIG. 13 is a schematic diagram of an embodiment of a four-way amplification circuit.

Furthermore, considering the two-way amplification circuit and the multiplex power processing circuit shown in FIG. 11 and FIG. 12, respectively, a four-way amplification circuit as illustrated in FIG. 13 can be formed. As shown in FIG. 13, ends of multiplex power processing circuits can connect to input ports or output ports of multiple amplifiers. Thus, a power of signals transmitted in the multiplex amplification circuit can be enhanced.

The foregoing disclosure of various embodiments has been presented for the purposes of illustration. It is not intended to be exhaustive or to limit the disclosure to the precise forms disclosed. Many variations and modifications of the embodiments described herein will be apparent to one of ordinary skill in the art in the light of the above disclosure. The scope of the disclosure is to be defined only by the claims appended hereto and their equivalents.

What is claimed is:

1. A power processing circuit, comprising:

a first portion;

a second portion;

a third portion;

a resistor, connected between the second portion and the third portion to isolate signals between the second portion and the third portion for decreasing signal interferences between the second portion and the third portion;

a first coupling portion, forming an U-shaped coupling structure and connected to the first portion, the second portion, and a ground; and a second coupling portion, forming another U-shaped coupling structure and connected to the first portion, the third portion, and the ground;

wherein the second coupling portion and the first coupling portion are symmetrically located about the resistor.

2. The power processing circuit as claimed in claim 1, wherein the first portion connects to an output port of external components to receive the signals from the external components, the second portion and the third portion connect to input ports of the external components respectively to transmit the signals to the external components when the processing circuit is dividing powers of the signals.

3. The power processing circuit as claimed in claim 1, wherein the first portion connects to an input port of external components to transmit the signals to the external components, the second portion and the third portion connect to the output ports of the external components respectively to receive the signals from the external components when the processing circuit is combining powers of the signals.

4. The power processing circuit as claimed in claim 1, wherein the first coupling portion and the second coupling portion both comprise two signal terminals; the two signal terminals of the first coupling portion connect to the first portion and the second portion respectively, and the two signal terminals of the second coupling portion connect to the first portion and the third portion respectively.

5. The power processing circuit as claimed in claim 1, wherein the U-shaped coupling structure of the first coupling portion and the another U-shaped coupling structure of the second coupling portion both comprise a first coupling line, a second coupling line, a first capacitor and a short microstrip line; in which a first end portion of the first coupling line, a first end portion of the second coupling line, and a first end portion of the first capacitor are connected together, a second end portion of the second coupling line connects to a first end portion of a short microstrip line, a second end portion of the first capacitor connects to the ground through a via.

6. The power processing circuit as claimed in claim 5, wherein the first coupling line and the second coupling line both form an L-shaped microstrip line and an L-shaped gap is defined between the first coupling line and the second coupling line to make electromagnetic waves couple together to form a mutual induction effect.

7. A multiplex power processing circuit, comprising a plurality of power processing circuits connected together, wherein each power processing circuit of the power processing circuits comprises:

a first portion;

a second portion;

a third portion;

a resistor, connected between the second portion and the third portion to isolate signals between the second portion and the third portion for decreasing signal interferences between the second portion and the third portion;

a first coupling portion, wherein the first coupling portion is an U-shaped coupling structure and connected to the first portion, the second portion, and a ground; and a second coupling portion, wherein the second coupling portion is an U-shaped coupling structure and connected to the first portion, the third portion, and the ground;

wherein the second coupling portion and the first coupling portion are symmetrically located about the resistor.

8. The multiplex power processing circuit as claimed in claim 7, wherein the second portion and the third portion of one power processing circuit of the power processing circuits connect to the first portions of another two power processing circuits of the power processing circuits.

9. The multiplex power processing circuit as claimed in claim 7, wherein the first portion connects to an output port of external components to receive the signals from the external components, the second portion and the third portion connect to input ports of the external components respectively to transmit the signals to the external components when the processing circuit is dividing powers of the signals.

10. The multiplex power processing circuit as claimed in claim 7, wherein the first portion connects to an input port of external components to transmit the signals to the external components, the second portion and the third portion connect to output ports of the external components respectively to receive the signals from the external components when the processing circuit is combining powers of the signals.

11. The multiplex power processing circuit as claimed in claim 7, wherein the first coupling portion and the second coupling portion both comprise two signal terminals;

the two signal terminals of the first coupling portion connect to the first portion and the second portion respectively, and the two signal terminals of the second coupling portion connect to the first portion and the third portion respectively.

12. The multiplex power processing circuit as claimed in claim 7, wherein the U-shaped coupling structure of the first coupling portion and the another U-shaped coupling structure of the second coupling portion both comprise a first coupling line, a second coupling line, a first capacitor and a short microstrip line, wherein a first end portion of the first coupling line, a first end portion of the second coupling line, and a first end portion of the first capacitor are connected together, a second end portion of the second coupling line connects to a first end portion of a short microstrip line, a second end portion of the first capacitor connects to the ground through a via.

13. The multiplex power processing circuit as claimed in claim 12, wherein the first coupling line and the second coupling line both form an L-shaped microstrip line and an L-shaped gap is defined between the first coupling line and the second coupling line to make electromagnetic waves couple together to form a mutual induction effect.

14. A multiplex amplification circuit, comprising a plurality of multiplex power processing circuits and multiple amplifiers, wherein a plurality of multiplex power processing circuits connect to input and output ports of the multiple amplifiers respectively, each multiplex power processing circuit comprises a plurality of power processing circuits, and each power processing circuit comprises:

a first portion;

a second portion;

a third portion;

a resistor, connected between the second portion and the third portion to isolate signals between the second portion and the third portion for decreasing signal interferences between the second portion and the third portion;

a first coupling portion, forming an U-shaped coupling structure and connected to the first portion, the second portion, and a ground; and a second coupling portion, forming another U-shaped coupling structure and connected to the first portion, the third portion, and the ground;

wherein the second coupling portion and the first coupling portion are symmetrically located about the resistor.

15. The multiplex amplification circuit as claimed in claim 14, wherein the second portion and the third portion of one power processing circuit of the multiple power processing circuits connect to the first portions of another two power processing circuits of the multiple power processing circuits.

16. The multiplex amplification circuit as claimed in claim 14, wherein the first portion connects to an output port of external components to receive the signals from the external components, the second portion and the third portion connect to input ports of the external components respectively to transmit the signals to the external components when the processing circuit is dividing powers of the signals.

17. The multiplex amplification circuit as claimed in claim 14, wherein the first portion connects to an input port of external components to transmit the signals to the external components, the second portion and the third portion connect to output ports of the external components respectively to receive the signals from the external components when the processing circuit is combining powers of the signals.

18. The multiplex amplification circuit as claimed in claim 14, wherein the first coupling portion and the second coupling portion both comprise two signal terminals; and the two signal terminals of the first coupling portion connect to the first portion and the second portion respectively, and the two signal terminals of the second coupling portion connect to the first portion and the third portion respectively.

19. The multiplex amplification circuit as claimed in claim 14, wherein the U-shaped coupling structure of the first coupling portion and the another U-shaped coupling structure of the second coupling portion both comprise a first coupling line, a second coupling line, a first capacitor and a short microstrip line; wherein a first end portion of the first coupling line, a first end portion of the second coupling line, and a first end portion of the first capacitor are connected together, a second end portion of the second coupling line connects to a first end portion of a short microstrip line, a second end portion of the first capacitor connects to the ground through a via.

20. The multiplex amplification circuit as claimed in claim 19, wherein the first coupling line and the second coupling line both form an L-shaped microstrip line and an L-shaped gap is defined between the first coupling line and the second coupling line to make electromagnetic waves couple together to form a mutual induction effect.

* * * * *